US006422149B1

(12) United States Patent
Saxby

(10) Patent No.: US 6,422,149 B1
(45) Date of Patent: Jul. 23, 2002

(54) BLANK TRAINING CARTRIDGE FOR A SELF LOADING GUN

(75) Inventor: Michael Ernest Saxby, Bexhill on Sea (GB)

(73) Assignee: Lambath Properties Limited, Nassau (BS)

( * ) Notice: Subject to any disclaimer, the term of this patent is extended or adjusted under 35 U.S.C. 154(b) by 0 days.

(21) Appl. No.: 09/479,469

(22) Filed: Jan. 10, 2000

(30) Foreign Application Priority Data

Aug. 27, 1999 (GB) ..... 9920201

(51) Int. Cl.[7] ..... F42B 8/00
(52) U.S. Cl. ..... 102/446; 102/444; 102/498
(58) Field of Search ..... 102/444, 446, 102/498

(56) References Cited

U.S. PATENT DOCUMENTS

| | | | | |
|---|---|---|---|---|
| 3,477,375 A | | 11/1969 | Barr | 102/45 |
| 3,528,662 A | | 9/1970 | Merchant et al. | 273/106.5 |
| 3,577,923 A | * | 5/1971 | Perkins et al. | 102/46 |
| 3,611,939 A | * | 10/1971 | Stadler et al. | 102/46 |
| 3,782,286 A | | 1/1974 | Jones et al. | 102/41 |
| 3,837,284 A | | 9/1974 | Waldeisen | 102/92 |
| 3,952,662 A | | 4/1976 | Greenlees | 102/92.7 |
| 4,128,059 A | | 12/1978 | Black | 102/92.7 |
| 4,204,474 A | | 5/1980 | Mizelle | 102/92.7 |
| 4,531,458 A | * | 7/1985 | Saxby | 102/440 |
| 4,637,616 A | | 1/1987 | Whiting | 273/418 |
| 4,686,905 A | | 8/1987 | Szabo | 102/444 |
| 4,823,702 A | | 4/1989 | Woolsey | 102/502 |
| 5,016,536 A | | 5/1991 | Brighton | 102/430 |
| 5,187,323 A | * | 2/1993 | Saxby | 102/440 |
| 5,677,505 A | | 10/1997 | Dittrich | 89/14.5 |
| 5,700,972 A | * | 12/1997 | Saxby | 102/440 |
| 6,178,889 B1 | * | 1/2001 | Dindl | 102/447 |

FOREIGN PATENT DOCUMENTS

| | | |
|---|---|---|
| GB | 1263522 | 2/1972 |
| GB | 1309362 | 3/1973 |
| GB | 1371482 | 10/1974 |
| GB | 2284252 A | 5/1995 |
| WO | WO 91/14916 | 10/1991 |
| WO | WO 95/05573 | 2/1995 |
| WO | WO 98/41810 | 9/1998 |

* cited by examiner

*Primary Examiner*—Charles T. Jordan
*Assistant Examiner*—Kimberly S Smith
(74) *Attorney, Agent, or Firm*—Lahive & Cockfield, LLP

(57) ABSTRACT

A cartridge for use in non-lethal applications comprising an anterior portion and a posterior portion. The posterior portion of the cartridge includes a recycling mechanism that is initiated by activating a first primer. The anterior portion of the cartridge includes a source of energetic material that is constructed to be initiated or activated by a reaction produced upon activation of the first primer to create an audible signal.

11 Claims, 3 Drawing Sheets

BLANK TRAINING CARTRIDGE FOR A SELF LOADING GUN

BACKGROUND OF THE INVENTION

The present invention relates to ammunition, particularly non-lethal ammunition intended for use in training or war games. More especially the invention relates to a telescopic cartridge in which rearwards movement of a portion of the cartridge is used to initiate the recycling of an automatic or semi-automatic firearm.

One form of cartridge of the above type is shown in FIG. 1 and is the subject of co-pending GB Patent Application 9819928.4, the contents of which are hereby incorporated by reference.

Cartridges of the type described above are suitable for use both in the firing of blanks and projectiles for the purposes of simulating warfare. Simulation may be for training purposes or for recreation. Whilst this cartridge has overcome many of the problems suffered by its predecessors, in providing a feel similar to that of a lethal loaded cartridge, neither it nor its predecessors have been able to provide a sound effect sufficiently reminiscent of a lethal loaded weapon.

The noise associated with the firing of lethal ammunition is considerable and has been difficult to simulate using non-lethal alternatives. Since the projectiles, if any, fired from previously known cartridges in training or simulation exercises are lighter in weight and travelling at much slower speeds than those used in lethal applications, they do not produce a noise on ejection from the firearm which is detectable from any significant distance. Thus, there is a problem for participants in the simulation to recognise when a shot has been fired and from which direction it came.

It is an object of the present invention to provide a cartridge for use with firearms in warfare training and simulation exercises which can go some way to alleviating these disadvantages.

SUMMARY OF THE INVENTION

In accordance with the present invention there is provided a cartridge for use in non-lethal applications comprising an anterior portion and a posterior portion, the posterior portion comprising a recycling mechanism, the recycling being initiated on activation of a first primer, and characterised by the anterior portion comprising a source of energetic material being initiatable by a reaction produced on activation of the first primer to create an audible signal on firing of the firearm characterised by a source of energetic material positioned forward of the gas channel, the energetic material being initiatable by the shock or pressure wave produced on initiation of the gas generating means.

The energetic material source provided toward the anterior end of the cartridge can conveniently be initiated by the shock or pressure wave associated with propellant gases used to propel the moveable member against the breech block. The energetic material can be chosen according to its pyrotechnic qualities to provide a noise reminiscent of any chosen lethal ammunition. Optionally, the energetic material may also produce a visual effect such as a flash of colour to simulate a lethal projectile exiting the firearm. Preferably, the energetic material is a non-toxic primer, this renders the cartridge more environmentally friendly and safer to use.

Thus the present invention provides two independent energetic sources, one to initiate the cycling of the reload mechanism and the other to perform a second function providing a noise reminiscent of a fired live bullet. By separating the propellant gas sources in this manner a more predictable response can be produced on repeated firings of the firearm using a cartridge according to the present invention. The feedback to the user on firing such a cartridge is more realistic of a typical feedback response from a lethal cartridge.

The cartridge itself may be of the type having a bullet like projection extending forwardly from the cartridge, the projection being retractable through an opening in the cartridge casing following firing of the cartridge. Alternatively, the cartridge may be provided with a nose portion at the anterior end the nose portion being suitable for receiving a projectile, the projectile being propellable on initiation of the energetic material.

A typical cartridge according to the present invention will comprise a posterior portion which has a moveable member which is slideable rearwardly towards a breech block, the anterior portion having a gas passage therethrough; an expansion chamber being provided between the moveable member and the anterior portion and gas generating means for providing gas within the cartridge, the gas generating means being initiatable on firing of the firearm to propel the moveable member in a rearward direction so as to recycle the firearm. The energetic material is positioned forward of the gas passage and may be initiated by any suitable reaction caused on initiation of the primer. For example, the shock or pressure wave generated on activation of the primer may be sufficient to initiate the energetic reaction in the energetic material, or alternatively, activation of the primer may activate a secondary mechanical or electrical device which serves to initiate the energetic material.

Preferably, the energetic material is chosen to release an audible signal which is less than about 140 decibels in volume. This enables shot recognition but reduces the potential to cause ear damage and/or the need to use ear defenders.

In certain embodiments, the moveable member may be provided in the form of a piston or cylinder slideably engaged respectively with a cylinder or a piston. Preferably in these embodiments, the moveable member is in the form of a piston slideably engaged respectively with a cylinder. Optionally, a bullet like projection is connected to or formed integrally with the moveable member arranged to extend forwardly from the cartridge, the projection being retractable through an opening in the cartridge casing following firing of the cartridge.

The energetic material may be positioned either in association with the moveable member or separately in the anterior portion of the casing.

BRIEF DESCRIPTION OF THE DRAWINGS

In order to further explain the invention, descriptions of two embodiments of the invention are now given with reference to the Figures in which.

DESCRIPTION OF THE PREFERRED EMBODIMENT

Figure 1:
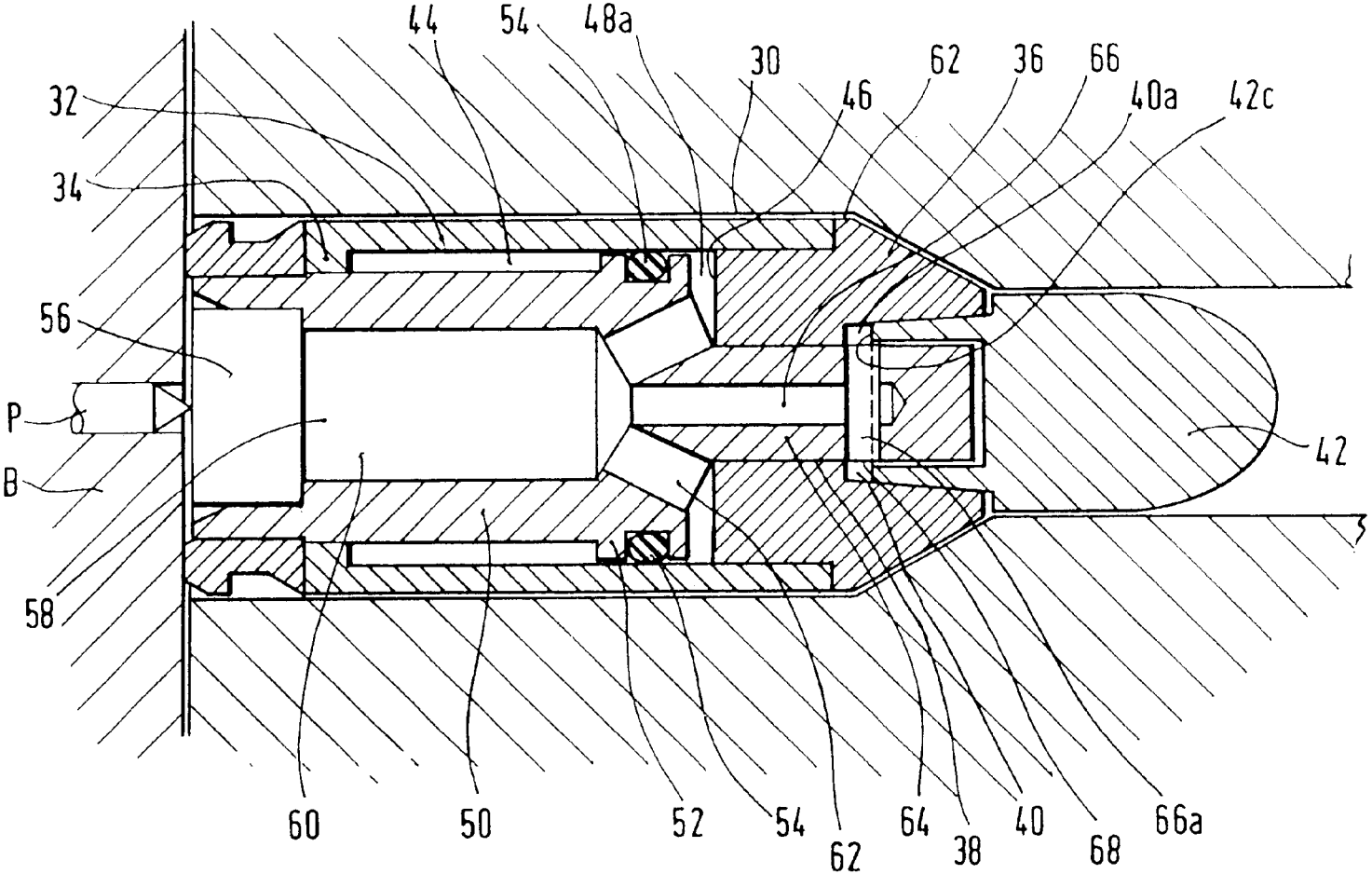
Fig. 1 (Prior Art)
FIG. 1 shows a prior art cartridge.

In FIG. 1, a gun cartridge 30 comprises a cylindrical cartridge case 32 with an in-turned flange 34 at the rearward end. The forward end casing comprises a nose portion 36, which in this embodiment is in the form of a plug, from which sleeve 44 extends in a rearwards direction. The plug 36 has an axial bore or gas passage 38, the axial bore being stepped so that the larger diameter forward section of the bore 40 forms a recessed seat in which is received the trailing end of a bullet 42.

The inner surface of the sleeve and the rearward surface 46 of the plug define a piston chamber 48. A piston 50 is slideably contained within the piston chamber 48 and has a pair of outwardly extending flanges 52 at its forward end. Nested between the flanges 52 and surrounding piston is an O-ring 54 to provide a seal between the forward end of the piston and the inner surface of the casing.

A pyrotechnic composition 56 is housed at the rearward end of the piston 50. Extending from the pyrotechnic composition to the forward end of the piston is a first gas expansion chamber 58. At the head of the gas expansion chamber 58, gas channels 62 allow the flow of propellant gas from the first expansion chamber 58 into the second expansion chamber 48*a* (which corresponds to the expansion chamber defined in the claims appended hereto), which is defined by the space between the piston head and the rearward surface 46 of the plug.

A spigot 64 extends from the forward end of the piston and is slideably contained within the axial bore or gas passage 38 of the plug. The spigot has an axial gas passage 66 therethrough which provides a gas flow path from the gas first expansion chamber 58 via laterally extending passage 66*a* to outlets 68. Outlets 68 open out into the larger diameter forward section 40 of the bore 38 immediately behind the rear edge 42*c* of the hollow cylindrical skirt portion of the bullet 42. The annular space 40*a* formed between the rear edge 42*c* of the bullet, the outer wall of the spigot and the axially facing surface 36*a* of the plug functions as a third expansion chamber.

In operation, the pyrotechnic composition is activated by the firearm's firing pin P and the propellant gas produced expands into the first gas expansion chamber 58 and through the passage 66 in the spigot 64 to the third expansion chamber 40*a*, thereby discharging the bullet 42 from its seat. At substantially the same instant, gas flows through the gas channels 62 between the first gas expansion chamber 58 and the second expansion chamber 48*a* at the front of the piston. The pressurised gas forces the piston to move rearwardly relative to the outer casing 32, thereby urging the spigot 64 in a rearwards direction against the breech block B. As a result of the rearward displacement of the piston and spigot, the outlets 68 are substantially sealed by the inner surface of the axial bore 38 so preventing the flow of gas to the forward section of the bore 40 (see FIG. 2).

Consequently, the full force of the remaining propellant gas is directed through the gas channels 62 as the piston shoots backwards against the breech block to recycle the firearm. The flange 52 on the forward end of the piston engages with the flange 34 on the rearward end of the casing 32, therefore preventing further rearward motion of the piston and expulsion of the piston from the cartridge casing.

Figure 2A:
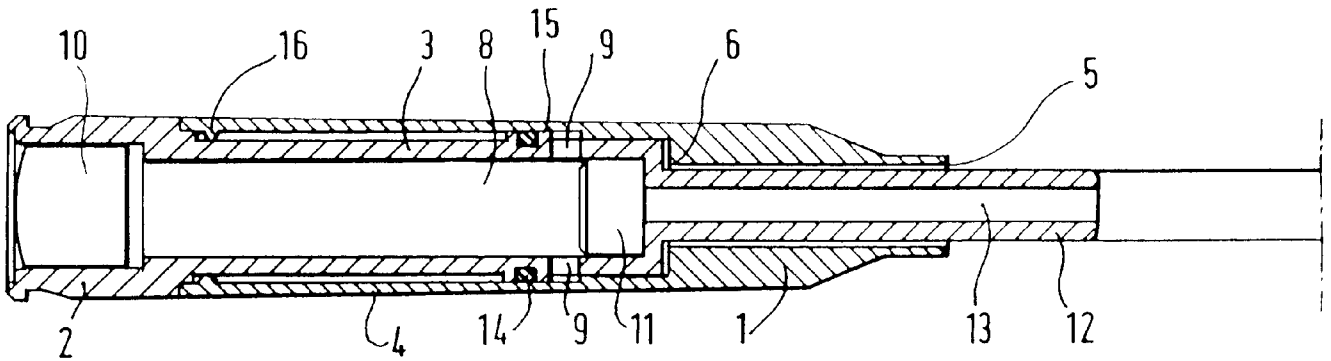
FIGS. 2*a* , 2*b* and 2*c* shows one embodiment of the invention of the type of cartridge having a bullet like projection extending forwardly from the cartridge, the projection being retractable through an opening in the cartridge casing following firing of the cartridge.
Figure 2B:
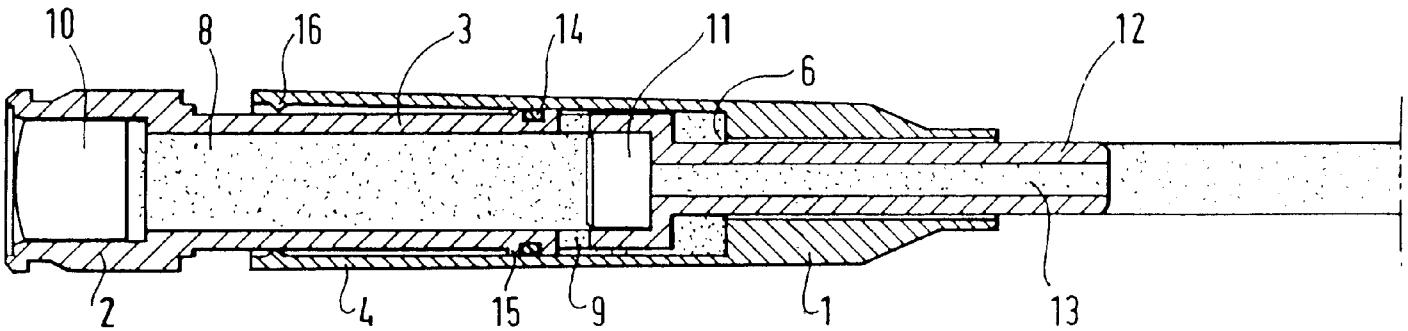
Figure 2C:
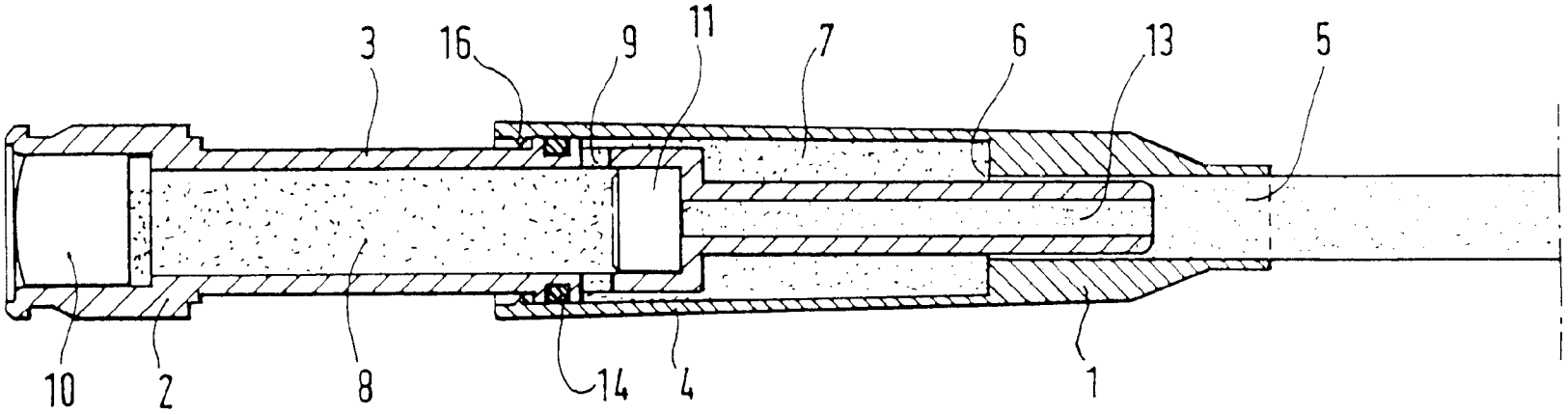

In FIGS. 2*a*, 2*b* and 2*c* a cartridge comprises an anterior portion 1 and a posterior portion 2, the posterior portion comprising a piston 3 slideable in a cylinder 4 extending rearwardly from the anterior portion 1. The anterior portion 1 is provided with a gas passage 5 which communicates with an expansion chamber 7 through a gas channel 6 positioned near the neck defining the join between the cylinder 4 and anterior portion 1. The piston 3 is provided with a hollow interior 8 and a plurality of channels 9 which connect between the hollow interior and the expansion chamber 7.

Disposed toward the posterior end of the piston 3 is a first primer 10 and towards the anterior end of the piston, forward of the channels 9 is a second primer 11. The anterior end of the piston 3 is provided with a protrusion 12, which is designed to give the appearance of a bullet and which, when the cartridge is correctly loaded, protrudes from the anterior portion 1 of the cartridge. There is minimal clearance between the circumference of the gas passage 5 in the anterior portion 1 and the outer circumference of the protrusion 12. The protrusion is provided with a channel 13 which is open at the anterior end.

A rubber sealing ring 14 is provided between the piston 3 and cylinder 4 to prevent passage of gas to the posterior portion 2. Adjacent the rubber sealing ring 14, the piston is provided with a rim of extended circumference 15, which, when the piston is allowed to extend from the cylinder, encounters a flange 16 provided on the inner circumference of the cylinder 4 to the posterior end of the cylinder 4.

In use, a firing pin (not shown) strikes the first primer 10 initiating an energetic response which produces a volume of gas in the hollow interior 8 of the piston 3. The gas progresses down the hollow interior 8 to the channels 9 and into the expansion chamber 7 where its continued expansion forces the piston 3 rearwardly against a breech block. The pressure/shock wave generated on ignition of the primer 10 initiates and energetic reaction in the nearby second primer 11 which explodes to give an acoustic effect much like that of fired lethal ammunition.

It is to be understood that the foregoing is merely exemplary of one embodiment of the invention and that modifications can be made thereto without departing from the scope of the invention.

What is a claimed is:

1. A cartridge for use in non-lethal applications comprising an anterior portion and a posterior portion, the posterior portion including a recycling mechanism, the recycling mechanism being initiated on activation of a first primer, and characterised by the anterior portion having a source of energetic material being initiatable by a pressure or shock wave produced on activation of the first primer to create one of an audible and a visible signal.

2. A cartridge as claimed in claim 1, wherein the posterior portion comprises a moveable member which is slideable rearwardly towards a breech block, the anterior portion having a gas passage therethrough; an expansion chamber being provided between the moveable member and the anterior portion; gas generating means for providing gas within the cartridge, the gas generating means being initiatable by the primer to propel the moveable member in a rearward direction against the breech block so as to recycle the firearm, the source of energetic material being positioned forward of the gas channel.

3. A cartridge as claimed in claim 2 wherein the moveable member is in the form of a piston or cylinder slideably engaged respectively with a cylinder or a piston.

4. A cartridge as claimed in claim 3 wherein the moveable member is in the form of a piston slideably engaged respectively with a cylinder.

5. A carriage as claimed in claim 2 wherein the energetic material is initiated by the pressure or shock wave produced on initiation of the gas generating means.

6. A cartridge as claimed in claim 1 wherein the anterior portion comprises a bullet like projection extending forwardly from the cartridge, the projection being retractable through an opening in the cartridge following firing of the cartridge.

7. A cartridge as claimed in claim 6 wherein the projection is connected to or formed integrally with the moveable member.

8. A cartridge as claimed in claim 1 wherein the energetic material is initiated by one of a mechanical means and an electrical means which are activated on initiation of the primer.

9. A method for recycling a firearm, comprising the steps of loading the firearm with a cartridge as claimed in claim 1, and firing the firearm.

10. The cartridge of claim 1, wherein the source of energetic material is initiatable free of heat and chemical gases generated by the first primer.

11. A cartridge for use in non-lethal applications comprising an anterior portion and a posterior portion, the posterior portion including a recycling mechanism, the recycling mechanism being initiated on activation of a first primer, and wherein the anterior portion includes a source of energetic material being initiatable by one of a mechanical and an electrical means which is activated on initiation of the first primer to create one of an audible and a visible signal.

* * * * *